US005445496A

United States Patent [19]

Brasz

[11] Patent Number: 5,445,496

[45] **Date of Patent: * Aug. 29, 1995**

[54] CENTIFUGAL COMPRESSOR WITH PIPE DIFFUSER AND COLLECTOR

[75] Inventor: Joost J. Brasz, Fayetteville, N.Y.

[73] Assignee: Carrier Corporation, Syracuse, N.Y.

[ * ] Notice: The portion of the term of this patent subsequent to Nov. 30, 2010 has been disclaimed.

[21] Appl. No.: 845,512

[22] Filed: Feb. 27, 1992

Related U.S. Application Data

[63] Continuation of Ser. No. 605,620, Oct. 30, 1990.

[51] Int. Cl.[6] ..... F04D 29/44

[52] U.S. Cl. ..... 415/208.3; 415/224.5

[58] Field of Search ..... 415/208.1, 208.2, 208.3, 415/203, 204, 206, 224.5

[56] References Cited

U.S. PATENT DOCUMENTS

| | | | |
|---|---|---|---|
| 2,114,285 | 4/1938 | Berger . | |
| 2,157,002 | 5/1939 | Moss | 415/208.3 |
| 2,977,042 | 3/1961 | Jassniker | 415/206 |
| 3,150,823 | 9/1964 | Adams | 415/208.3 |
| 3,316,848 | 5/1967 | Egger | 415/204 |
| 3,489,340 | 1/1970 | Holzhausen | 415/204 |
| 3,604,818 | 9/1971 | Cronstedt et al. | 415/208.3 |
| 3,964,837 | 6/1976 | Exley | 415/208.3 |
| 4,012,166 | 3/1977 | Kaesser et al. | 415/208.3 |
| 4,027,997 | 6/1977 | Bryans | 415/208.3 |
| 4,302,150 | 11/1981 | Wieland | 415/208.3 |
| 4,576,550 | 3/1986 | Bryans | 415/208.3 |

*Primary Examiner*—Edward K. Look
*Assistant Examiner*—Christopher Verdier

[57] ABSTRACT

A channel type diffuser is applied to a centrifugal compressor to obtain substantially complete expansion of the refrigerant downstream of the impeller wheel. The relatively large volume of expanded gases that results from such a diffusion process is accommodated by the use of a relatively large volume collecter with a uniform circumferential cross section. The result is higher efficiencies and a more stable operating range.

2 Claims, 5 Drawing Sheets

CENTIFUGAL COMPRESSOR WITH PIPE DIFFUSER AND COLLECTOR

This application is a continuation of application Ser. No. 07/605,620 filed Oct. 30, 1990.

BACKGROUND OF THE INVENTION

This invention relates generally to refrigerant compressors and, more particularly, to centrifugal compressors with a unique diffuser and collector combination for obtaining high efficiency performance.

In large capacity air conditioning systems using water-cooled chillers, centrifugal compressors are most commonly used. The refrigerant of choice in such compressors has commonly been CFC-11, which is relatively high in thermodynamic cycle efficiency.

Given the use of this common refrigerant, and given the system capacity requirements for a particular installation (i.e. the head or pressure ratio and the flow requirements), then the size of the various components can be determined. If the speed is considered to be fixed, as is generally the case, then the impeller diameter and width are chosen to fit the particular capacity requirements. It is, of course, the impeller which accelerates the refrigerant to a high velocity, after which it is necessary to decelerate the refrigerant to a low velocity while converting kinetic energy to pressure energy. This is commonly done with the diffuser and, to some extent, with the chamber into which the diffuser discharges its refrigerant.

With the use of CFC-11 as the refrigerant, it is generally understood that complete diffusion (i.e. the conversion of substantially all of the kinetic energy to pressure energy) cannot be accomplished within the normal constraints of available diffuser space. That is, such a diffuser would be inordinately large with respect to the drive motor and gear systems, and would severely detract from the practical application of such a system. The normal approach is therefore to complete the diffusion process in a spiral shaped casing called a volute. The volute therefore functions to both complete the diffusion process and to collect the discharge vapor for subsequent flow to the condenser. While the volute with its gradually increasing cross section provides an optimum design for the use of available space, it is recognized that some efficiency is lost in the diffusion that takes place in the volute.

Typical centrifugal compressors have a volute with an outside diameter which is about twice the impeller diameter. Under these geometrical conditions, the amount of diffusion in the compressor is therefore limited. To obtain further diffusion, it would not only require a larger diffuser outside diameter, and therefore a larger volute diameter, but it would also require a larger cross sectional area in the volute in order to enable the passing of a given volumetric flow rate at lower velocities. Because of these constraints, centrifugal compressors with conventional, size-limited diffuser/volute combinations experience increased circumferential flow distortions under part load conditions when the volute becomes oversized and starts acting as a circumferential diffuser. Resulting circumferential pressure buildup and its corresponding flow nonuniformities have been felt upstream of the diffuser and even at the inlet of the impeller. The effects of these nonuniformities on overall compressor performance are loss in efficiency and a reduction of stable operating range under part load conditions.

It is therefore an object of the present invention to provide an improved centrifugal compressor method and apparatus.

Another object of the present invention is the provision in a centrifugal compressor for improving the efficiency thereof while remaining within the given geometric constraints.

Yet another object of the present invention is the provision in a centrifugal compressor for avoiding the performance losses that result from circumferential flow distortions under part load conditions.

Still another object of the present invention is the provision in a centrifugal compressor for more efficiently converting the kinetic energy to pressure energy and for collecting the decelerated gas for use in the condenser.

Still another object of the present invention is the provision for a centrifugal compressor which is economical to manufacture and efficient and effective in use.

These objects and other features and advantages become more readily apparent upon reference to the following description when taken in conjunction with the appended drawings.

SUMMARY OF THE INVENTION

Briefly, in accordance with one aspect of the invention, a relatively high density refrigerant gas (e.g. HCFC-22) is used in a centrifugal compressor such that, when applying conventional scaling laws, the linear size of the aerodynamic components may be reduced to such an extent that the motor and drive apparatus becomes the size determining elements rather than the aerodynamic structure, with the reduced size then allowing provision for obtaining complete conversion of kinetic energy to pressure energy within the diffuser, so as to thereby provide for higher efficiencies. In this way, the efficiency of the diffusion process is optimized while remaining within the geometric constraints.

By another aspect of the invention, the diffuser comprises a pipe diffuser having a plurality of circumferentially spaced, generally radially extending, frustro-conical channels whose lengths are chosen such that they provide a 5:1 area ratio to thereby allow for substantially complete diffusion of the refrigerant gases.

By yet another aspect of the invention, the conventional volute of a centrifugal compressor is replaced with a circumferentially symmetrical collector for receiving the low velocity gas from the diffuser. Because of the substantially complete diffusion that occurs in the diffuser, the circumferential pressure distortion that occurs in the collector due to nonuniform velocities will be minimal. Further, because of the relatively larger cross sectional area of the collector, as compared with that of a volute, the relatively larger flow volumes resulting from the more complete diffusion of the refrigerant gases can be accommodated without restriction. In this way, the use of a channel diffuser, wherein substantially complete diffusion takes place, and a relatively large collector with a uniform circumferential cross section, are used effectively in combination to bring about optimum efficiency over a large stable operating range, and all within the given geometric constraints.

In the drawings as hereinafter described, a preferred embodiment is depicted; however, various other modifications and alternate constructions can be made thereto without departing from the true spirit and scope of the invention.

DESCRIPTION OF PREFERRED EMBODIMENT

Figure 1:
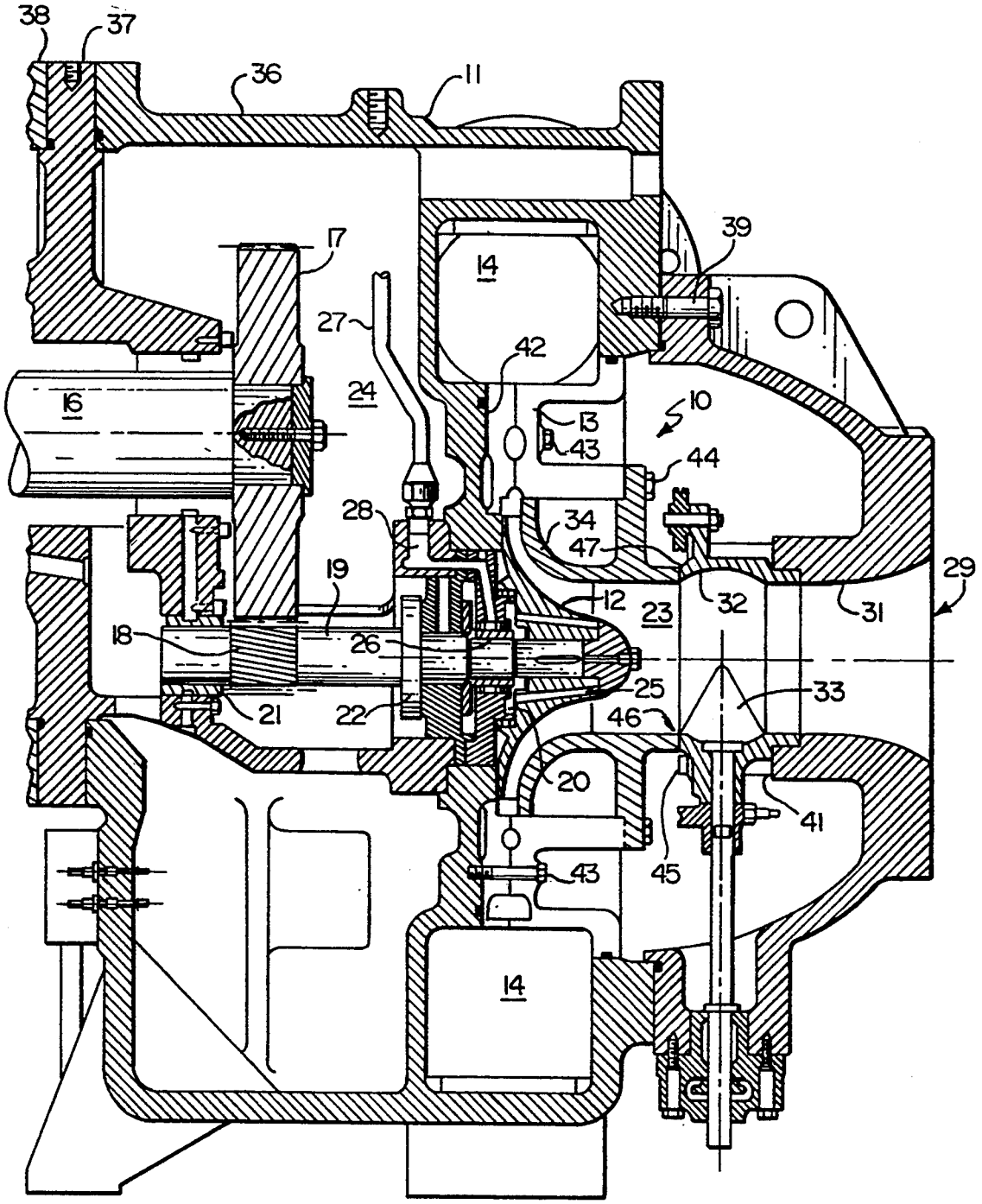
FIG. 1 is a partial sectional view of a centrifugal compressor having the present invention incorporated therein.

Referring now to FIG. 1, the invention is shown generally at 10 as installed in a centrifugal compressor 11 having an impeller 12 for accelerating refrigerant vapor to a high velocity, a diffuser 13 for decelerating the refrigerant to a low velocity while converting kinetic energy to pressure energy, and a discharge plenum in the form of a collector 14 to collect the discharge vapor for subsequent flow to a condenser. Power to the impeller 12 is provided by an electric motor (not shown) which is hermetically sealed in the other end of the compressor and which operates to rotate the low speed shaft 16 which, in turn, is drivingly connected to a drive gear 17, a driven gear 18, and a high speed shaft 19.

The high speed shaft 19 is supported by the bearings 21 and 22 on either end thereof, with the bearing 22 acting as both a journal bearing to maintain the radial position of the shaft 19 and as a thrust bearing to maintain the axial position thereof.

In order to provide a counteraction to the aerodynamic thrust that is developed by the impeller 12, a balance piston is provided by way of a low pressure cavity 20 behind the impeller wheel 12. A plurality of passages 25 are provided in the impeller 12 in order to maintain the pressure in the cavity or balance piston 20 at the same low pressure as that in the compressor suction area indicated generally by the numeral 23. Since the pressure in the cavity 24 is higher than that in the cavity 20, and especially at part load operation, a labyrinth seal 26 is provided between the bearing 22 and the impeller 12 to seal that area against the flow of oil and gas from the transmission into the balance piston 20. This concept is well known, as is the further concept of pressurizing the labyrinth seal by exerting high pressure gas thereon. The high pressure vapor for pressurizing the labyrinth seal is introduced by way of the line 27 and its associated passages indicated at 28.

Referring now to the manner in which the refrigerant flow occurs in the compressor 11, the refrigerant enters the inlet opening 29 of the suction housing 31, passes through the blade ring assembly 32 and the guidevanes 33, and then enters the compression suction area 23 which leads to the compression area defined on its inner side by the impeller 12 and on its outer side by the shroud 34. After compression, the refrigerant then flows into the diffuser 13, the collecter 14 and the discharge line (not shown).

It will be seen that the compressor base 36, which has the collector 14 as an integral part thereof, is attached to the transmission case 37 and to the motor housing 38 by appropriate fasteners such as bolts (not shown) or the like. In turn, the suction housing 31 is attached to the compressor base 36 by a plurality of bolts 39. The blade ring assembly 32 is then secured to the inner end 41 of the suction housing 31 by bolts 45.

Prior to installing the suction housing 31 to the compressor base 36, the diffuser 13 is attached to an annular face 42 of the compressor base 36 by a plurality of bolts 43 as shown. The shroud 34 is then secured to the diffuser structure by a plurality of bolts 44. A small gap 46 is then allowed to remain between the intake end 47 of the shroud 34 and the downstream side of the blade ring assembly 32.

Figure 3:
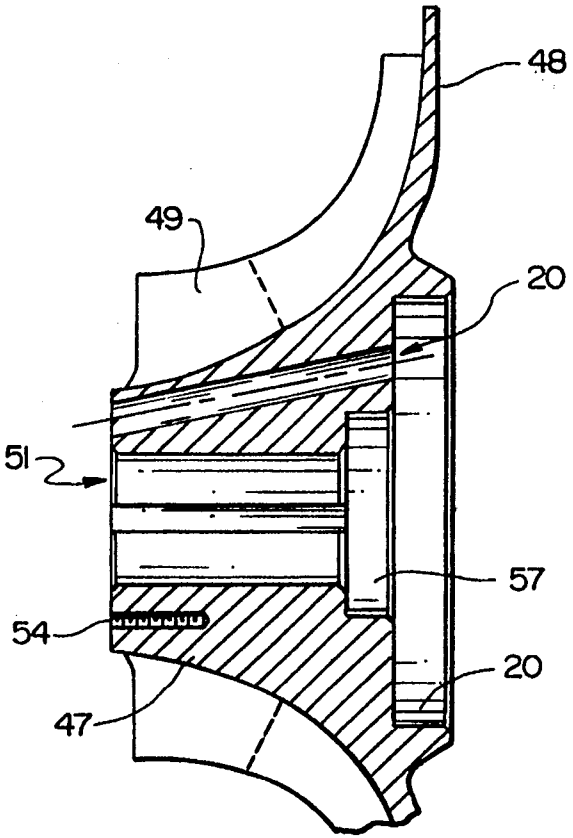
FIG. 3 is a sectional view as seen along lines 3—3 thereof.
Figure 2:
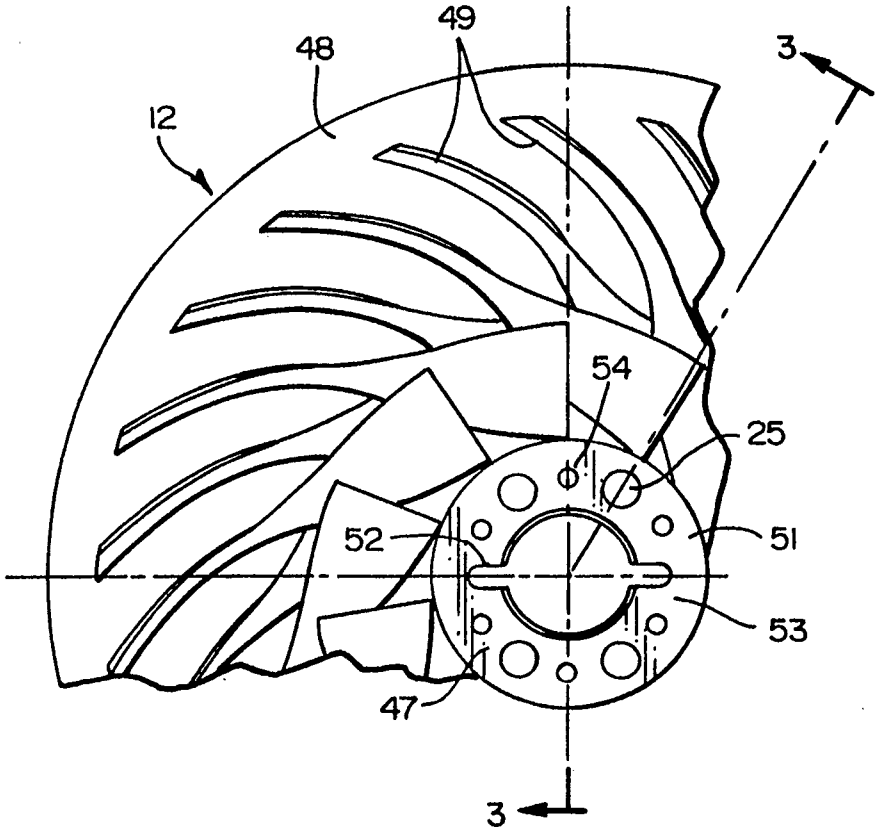
FIG. 2 is a partial end view of the impeller portion of the invention.

Referring now to FIGS. 2 and 3, the impeller wheel 12 is shown in greater detail to include hub 47, the integrally connected and radially extending disk 48, and a plurality of blades 49. Formed in the hub 47 is a hub bore 51 and key ways 52 and 53 for drivingly installing the impeller wheel 12 on the high speed shaft 19. Also formed in the hub 47 is the plurality of passages 25 for establishing the proper pressures for the balance piston 20 as discussed hereinabove, and a plurality of tapped holes 54 for securing the nose cone 56 to the impeller wheel as shown in FIG. 1. The impeller wheel is designed to operate at a pressure ratio of at least 2 to 1.

On the rear side of the impeller hub 47 is the shallow cylindrical cavity 20 which communicates with a low pressure area by way of the passages 25 in order to function as a balance piston as described hereinabove. In addition, an annular cavity 57 is formed nearer to the bore 51 for purposes of stress relief of the keyway passages 52 and for purposes of shimming to set the axial position of the impeller 12.

Figure 5:
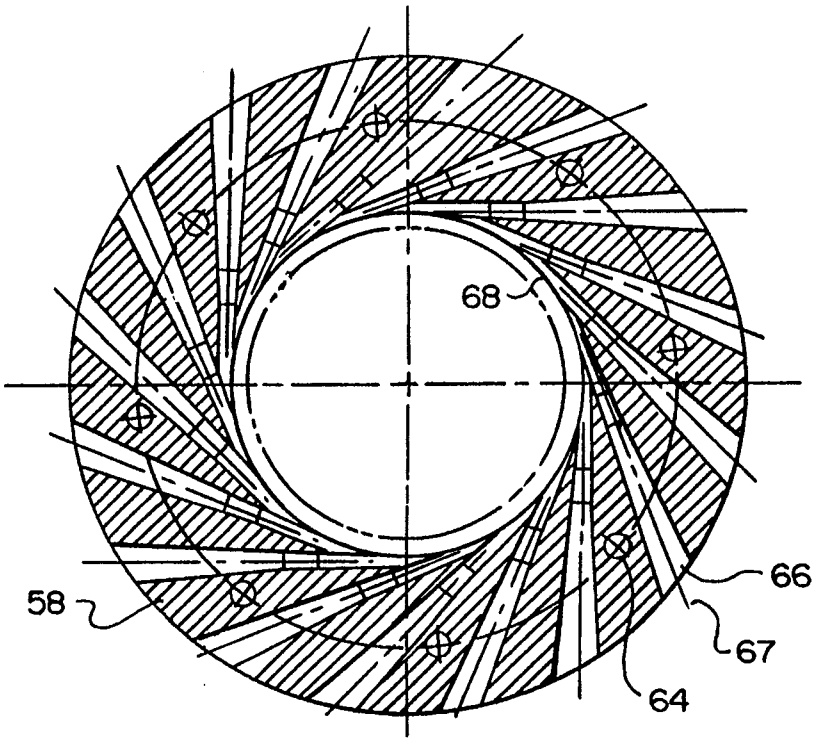
FIG. 5 is a sectional view as seen along lines 5—5 thereof.
Figure 4:
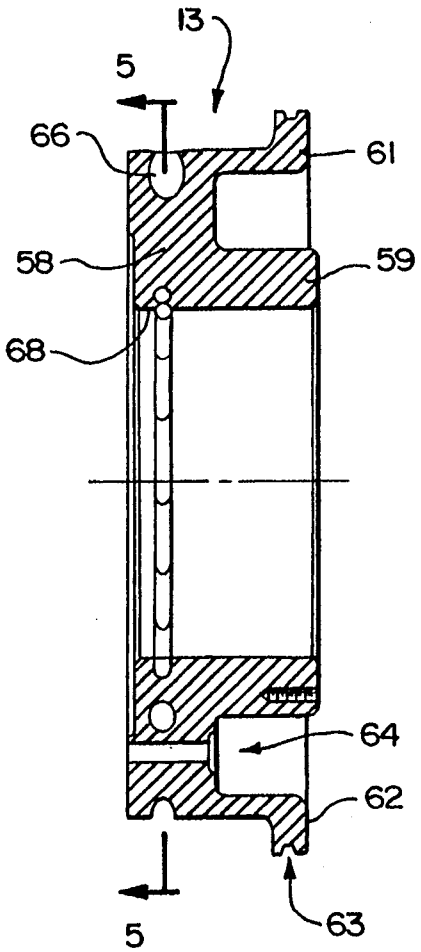
FIG. 4 is an axial sectional view of the diffuser portion of the invention.
Figure 6:
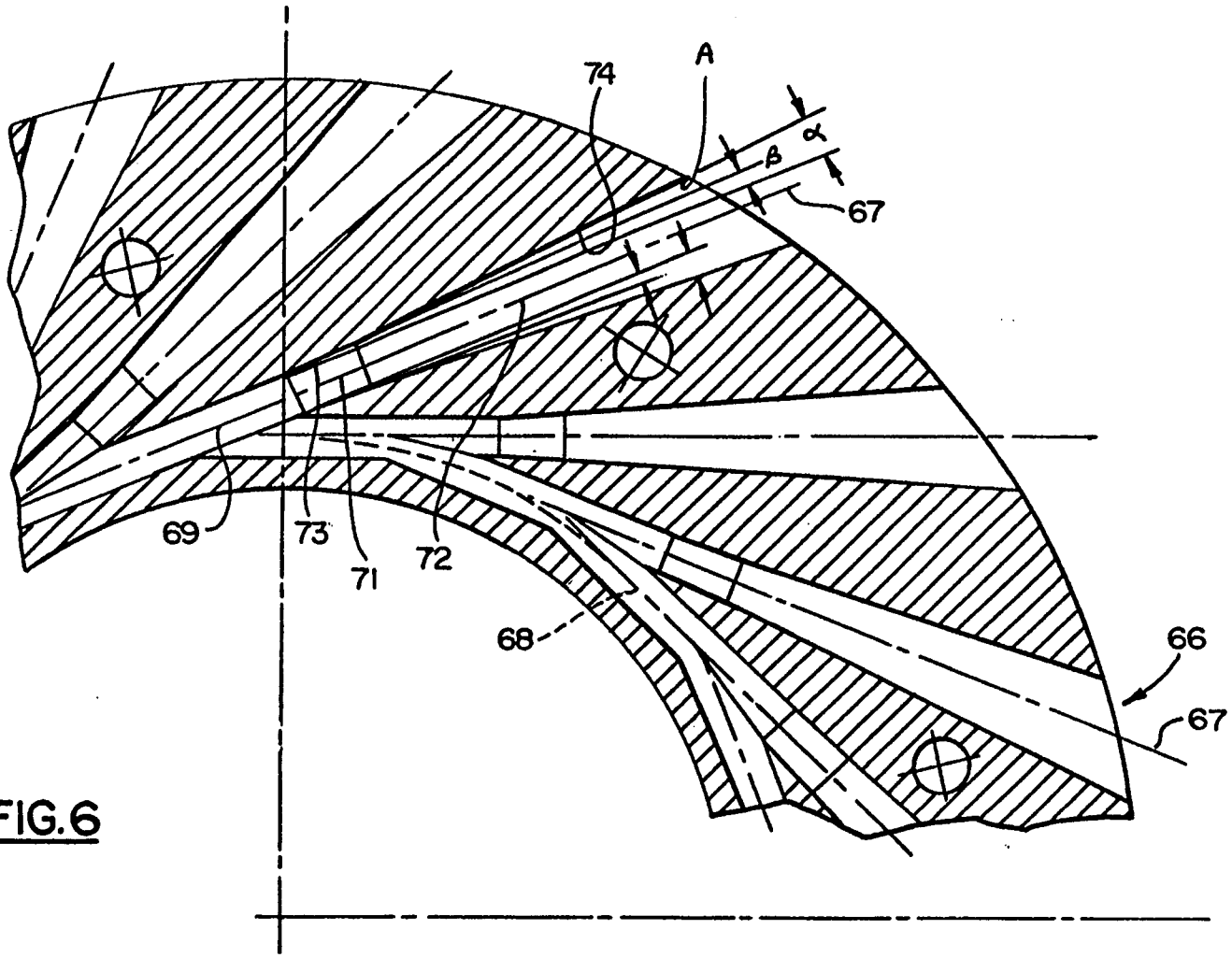
FIG. 6 is a partial enlarged view thereof.

The diffuser 13 is shown in greater detail in FIGS. 4–6. It is formed of a single annular casting and includes a body or ring portion 58, an inner annular flange 59, and an outer annular flange 61. The inner annular flange 59 serves to support the shroud structure 34 which is attached thereto by a plurality of bolts 44 as discussed hereinabove. The outer annular flange 61 has a radially extending rim 62 which engages an inner surface of the collecter 14 as shown in FIG. 1. A groove 63 is formed in the end of the rim 62 to contain an annular seal (not shown) for preventing leakage of refrigerant from between the rim 62 and the edge of the collecter 14.

Formed in the ring portion 58 of the diffuser 13 is a plurality of holes 64 for receiving the bolts 43 which secure the diffuser 13 to the collecter structure 14 as shown in FIG. 1. Also formed in the ring portion 58, by machining or the like, is a plurality of circumferentially spaced, generally radially extending, tapered channels 66, whose center lines 67 are tangent to a common circle indicated generally at 68 and commonly referred to as the tangency circle.

As will be seen in FIG. 6, each of the tapered channels 66 has three serially connected sections, all concentric with the axis 67, as indicated at 69, 71 and 72. The first section 69 is cylindrical in form, (i.e., with a constant diameter) and is angled in such a manner that it crosses similar sections on either circumferential side thereof. A second section indicated at 71 has a slightly flared axial profile with the walls 71 being angled outwardly at an angle $\beta$ with the wall of section 69 or with the axis 67. An angle that has been found to be suitable for $\beta$ is 2°. The third section 72 has an axial profile which is flared even more with the walls 72 being angled at an angle $\alpha$ with the wall of section 69 or with the center line 67. An angle which has been found suitable for the angle $\alpha$ is 4°. That is, the angle between the opposed walls of section 71 is 4° and that between the opposed walls of section 72 is 8°. Such a profile of increasing area toward the outer ends of the channel 66, is representative of the degree of diffusion which is caused to take place in the diffuser 13 and is quantified by the equation:

$$\text{area ratio} = \frac{\text{area at exit of channel}}{\text{area at inlet of channel}}$$

wherein the area of the exit is taken normal to the axis at the location identified at A on FIG. 6.

As mentioned hereinabove, it is desirable that essentially complete diffusion takes place in the diffuser 13, such that the refrigerant gas is not further expanded when it enters into the collecter structure 14. In order for such complete diffusion to occur, it is desirable that the area ratio be on the order of 5 to 1 or greater. With such an established area ratio in the diffuser, the refrigerant gas leaving the diffuser will then be fully expanded so as to require a substantially large discharge area in which to be collected for further distribution downstream. The relatively large collecter apparatus 14 is therefore provided for that purpose.

Figure 8:
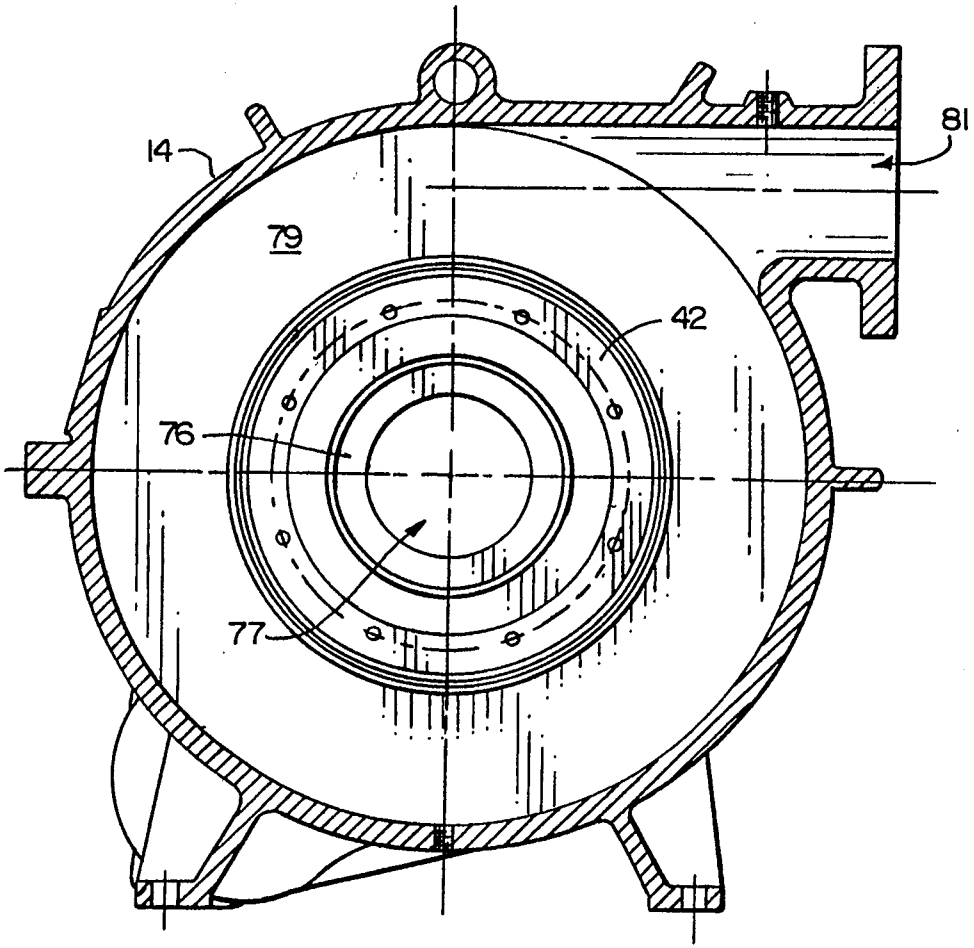
FIG. 8 is a sectional view as seen along lines 8—8 thereof.
Figure 7:
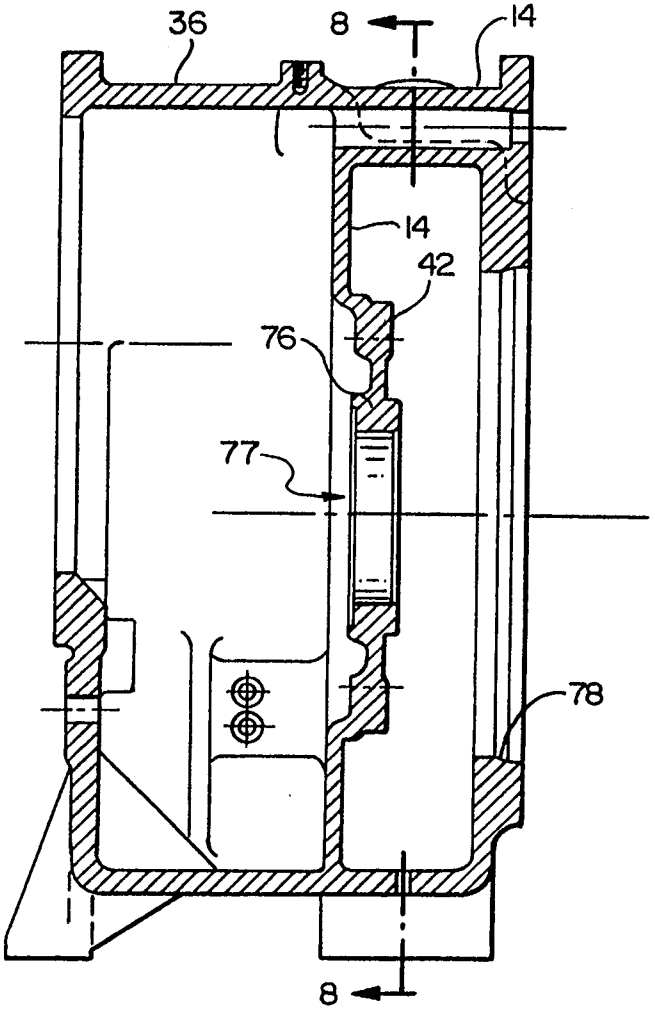
FIG. 7 is a sectional view of the collecter portion of the invention.

Referring now to FIGS. 7 and 8, the compressor base 36, with the integrally formed collector structure 14, is shown. It will be seen that a radially extending wall 76 with its opening 77 provides the supporting structure for the impeller wheel 12, its drive shaft 19 and its bearing 22. As the wall 76 extends radially outwardly, its surface 42 is used to support the diffuser 13 which is secured thereto, and, as it extends even further radially outwardly, the toroidal shaped collecter 14 is formed as shown with a circumferential cross section that is relatively large and uniform in shape. The structure terminates at the radially inward end 78 which is adapted to interface with the groove 63 of the rim 62 of the diffuser 13 as described above.

Because of the relatively large size of the defined plenum 79 within the collecter structure 14, the fully diffused or expanded refrigerant gases passing from the diffuser 13 are allowed to collect in the plenum 79 without any significant restriction prior to being passed along the discharge opening 81 to the condenser.

While the present invention has been disclosed with particular reference to a preferred embodiment, the concepts of this invention are readily adaptable to other embodiments, and those skilled in the art may vary the structure thereof without departing from the essential spirit of the invention. For example, although the diffuser 13 has been described in terms of a so called pipe diffuser structure, other types of channeled diffusers such as a wedge type diffuser can be used in combination with the collecter structure in order to obtain the present invention.

What is claimed is:

1. An improved centrifugal compressor of the type having an impeller for imparting kinetic energy to a refrigerant gas to be compressed, a diffuser for converting a portion of said kinetic energy to potential energy, and a discharge chamber for receiving a flow of refrigerant from the diffuser, wherein the improvement comprises:

said diffuser having a plurality of circumferentially spaced, generally radially extending, flared channel means with exit and inlet openings having cross sectional areas such that the ratio of exit area to inlet area is greater than 5 to 1 so as to enable the removal of substantially all of the kinetic energy from a refrigerant gas being received from said impeller and wherein said channels each comprise two serially connected sections, with a first radially inward section having diverging opposed walls angled at one angle, and a second radially outward section having diverging opposed walls angled at a larger second angle; and said discharge chamber being of a collector type wherein a radial cross sectional area thereof is substantially circumferentially uniform.

2. An improved centrifugal compressor as set forth in claim 1 wherein the angle between the opposed walls in the first section is four degrees and the angle between the opposed walls in the second section is eight degrees.

* * * * *